US007730673B2

(12) United States Patent
George

(10) Patent No.: US 7,730,673 B2
(45) Date of Patent: Jun. 8, 2010

(54) WINDOW WELL ASSEMBLY

(75) Inventor: Glen R. George, Grand Ledge, MI (US)

(73) Assignee: Tapco International Corporation, Wixom, MI (US)

( * ) Notice: Subject to any disclaimer, the term of this patent is extended or adjusted under 35 U.S.C. 154(b) by 440 days.

(21) Appl. No.: 11/681,425

(22) Filed: Mar. 2, 2007

(65) Prior Publication Data

US 2008/0010911 A1 Jan. 17, 2008

Related U.S. Application Data

(60) Provisional application No. 60/778,559, filed on Mar. 2, 2006.

(51) Int. Cl.

| | |
|---|---|
| ***E04F 17/06*** | (2006.01) |
| ***E02D 19/00*** | (2006.01) |
| ***E02D 27/00*** | (2006.01) |
| ***E04B 1/32*** | (2006.01) |
| ***E04B 2/00*** | (2006.01) |

(52) U.S. Cl. ..... 52/107; 52/592.5; 52/592.6; 52/246; 52/247; 52/169.5; 52/169.8

(58) Field of Classification Search ..... 52/182, 52/300–301, 592.1, 592.5–592.6, 246–249, 52/169.1–169.9, 191, 204.56

See application file for complete search history.

(56) References Cited

U.S. PATENT DOCUMENTS

| | | | | |
|---|---|---|---|---|
| 980,442 | A * | 1/1911 | Schlafly | 405/48 |
| 1,916,202 | A * | 7/1933 | Bubien | 248/311.2 |
| 3,004,634 | A * | 10/1961 | Evans et al. | 52/107 |
| 3,667,185 | A * | 6/1972 | Maurer | 52/537 |
| 3,969,866 | A * | 7/1976 | Kyne | 52/588.1 |
| 4,101,049 | A * | 7/1978 | Wallace et al. | 206/521.1 |
| 4,704,828 | A * | 11/1987 | Kemp | 52/107 |
| 6,298,631 | B1 * | 10/2001 | Finley | 52/742.15 |
| 6,988,654 | B2 * | 1/2006 | Wnek | 229/406 |
| 2005/0252103 | A1 * | 11/2005 | Cook | 52/107 |
| 2005/0268564 | A1 * | 12/2005 | Theophilus | 52/107 |
| 2007/0089373 | A1 * | 4/2007 | Heady et al. | 52/107 |

* cited by examiner

*Primary Examiner*—Brian E Glessner
*Assistant Examiner*—Omar Hijaz
(74) *Attorney, Agent, or Firm*—Howard & Howard Attorneys PLLC

(57) ABSTRACT

A window well assembly for buildings and the like include at least a first well unit and a second well unit each having opposite first and second flanges at opposite ends of a retaining wall of each unit for securing the well units to a sub-grade foundation of the building. Preferably, the assembly has a plurality of releasable spacer couplings that are mated and carried between well units when the assembly is in a stored state, and has indexing features that are mated and carried between well units when the assembly is in an assembled state.

21 Claims, 4 Drawing Sheets

WINDOW WELL ASSEMBLY

CROSS-REFERENCE TO RELATED APPLICATION

The present application claims priority to the filing date of the U.S. Provisional Patent Application Ser. No. 60/778,559, filed Mar. 2, 2006.

BACKGROUND OF THE INVENTION

Various types of window wells have been developed for retaining earth and the like around windows in houses or other buildings that are at least partially below grade. Such window wells typically have a generally vertical retaining wall that is U-shaped in plan view, with flanges extending along opposite end edges of the retaining wall. The flanges provide a connection means to secure the window well to a foundation of the building. Known window well may be made from metal, polymer, or other suitable materials.

Such window wells are typically quite large, and therefore require substantial space for storage, transportation, and the like. Although nesting of window wells to decrease the space requirements is typically attempted, various problems have been encountered. For example, the window wells may bind together when nested, thereby creating difficulty when separating the individual window wells for installation and the like. Furthermore, if a large number of window wells are nested, and/or an external force is applied, the window wells may become deformed or damaged.

SUMMARY OF THE INVENTION

A window well assembly for buildings and the like include at least a first well unit and a second well unit each having opposite first and second flanges at opposite ends of a retaining wall of each unit for securing the well units to a sub-grade foundation of the building. Preferably, the assembly has a plurality of releasable spacer couplings that are mated and carried between well units when the assembly is in a stored state, and has indexing features that are mated and carried between well units when the assembly is in an assembled state.

The spacer coupling is preferably carried between common, adjacent, flanges of the first and second well units. Each coupling has an elongated protrusion projecting outward from an outward surface of the flange and spaced outward from an outward face of the retaining wall. When the assembly is in the stored state, a bore of the coupling in each flange of the well unit receives a distal end of the protrusion projecting from the adjacent well unit thus mating the coupling. This mating of the distal end in the bore prevents distortion of the well units when in the stored state. Preferably, each coupling also has a web spanning between the outward face of the retaining wall and the protrusion. A distal stop edge of the web is spaced sufficiently from the outward surface of the contiguous flange so that when the assembly is in the stored state, an inward surface of a flange of the next adjacent unit is in contact with the distal stop edge. This spacing created by the stop edge prevents the units from sticking together when in the stored state.

The indexing feature is generally carried between overlapped portions of common, adjacent flanges of the first and second well units. Each indexing feature has a rib projecting outward from the outward surface of the flange of the first well unit and a notch defined by a distal edge of the flange of the adjacent well unit. When the assembly is in the assembled state, the rib of the first well unit projects into the notch of the adjacent flange and is generally snap fitted to the distal edge of the adjacent flange of the second well unit.

Objects, features and advantages of the present invention include a window well assembly having a plurality of well units that can be stacked or nestled in a compact arrangement for packaging, storage and shipping without becoming stuck together or deformed. Other advantages include a relatively lightweight assembly that is versatile, robust, inexpensive to manufacture, and easy to assemble.

BRIEF DESCRIPTION OF THE DRAWINGS

These and other objects, features and advantages of this invention will be apparent from the following detailed description, appended claims, and accompanying drawings in which:

DETAILED DESCRIPTION OF PREFERRED EMBODIMENTS

Figure 1:
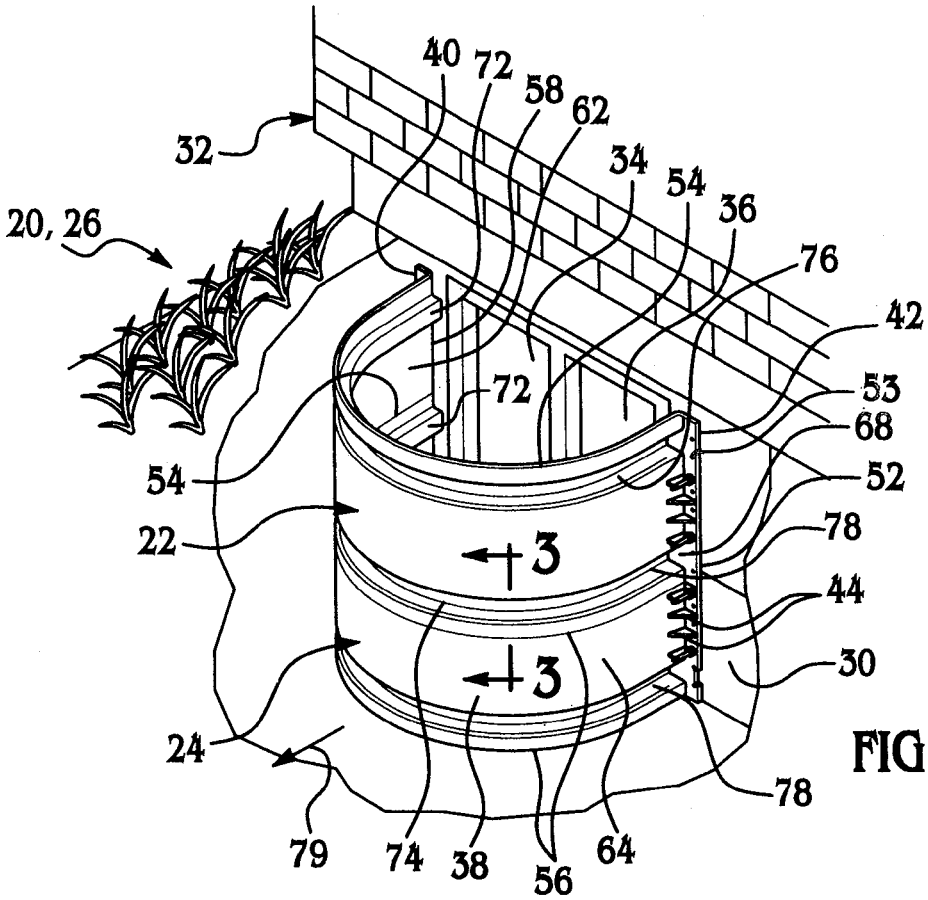
FIG. 1 is a perspective view of a window well assembly in an assembled state and in accordance to one aspect of the present invention.
Figure 2:
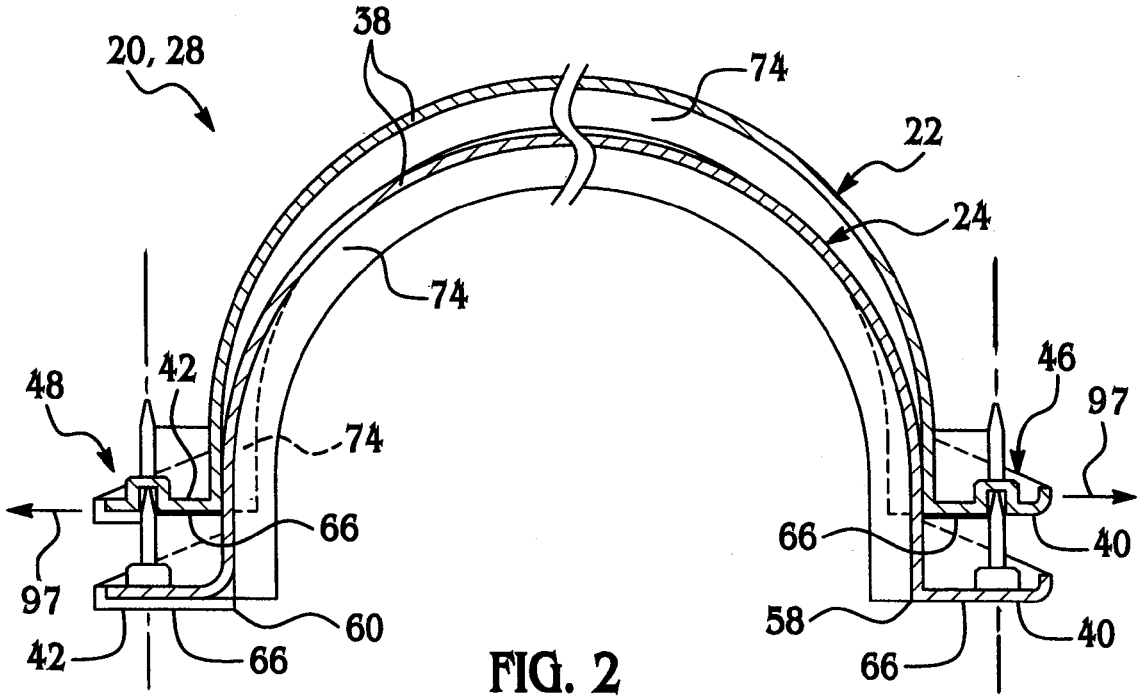
FIG. 2 is a side view of the window well assembly in a stored state.

Referring to FIGS. 1 and 2, a window well assembly 20 embodying the present invention preferably has at least a first well unit 22 and a second well unit 24 illustrated in an assembled state 26 and a stored state 28. When in the assembled state 26, any one of the well units 22, 24 is stacked above the other well unit and when installed, the well units are secured to a subgrade foundation 30 of a building 32 and preferably at window or egress 34 in the foundation. An access cavity 36 is defined between the foundation 30 and the assembly 20. When in the stored state 28, the assembly is yet to be installed and is orientated for compact and secure packaging, storage and shipping. Although only two well units 22, 24 are illustrated for explanation purposes, any number of well units as the assembly 20 would be applicable and workable because all units are preferably identical to one another. Each well unit 22, 24 is preferably made of a polymer material and preferably is injection molded plastic wherein each unit is one unitary piece.

Figure 6:
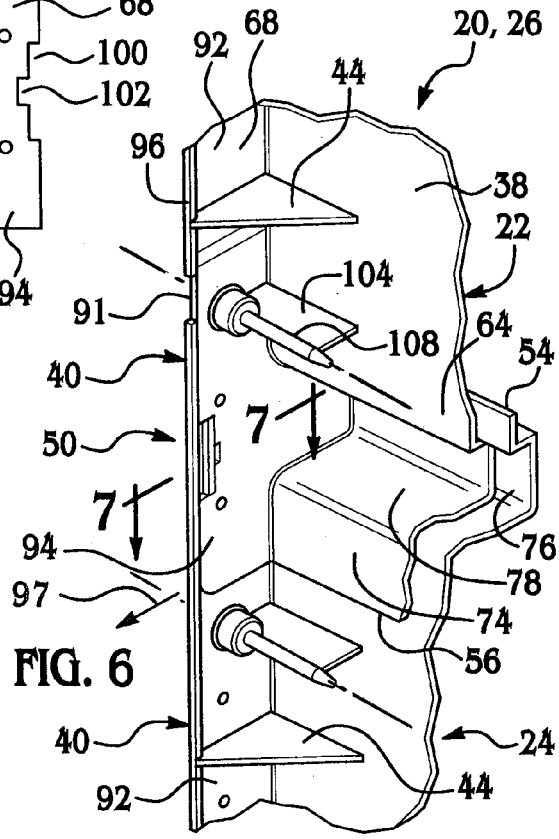
FIG. 6 is an enlarged partial perspective view of the first flanges of respective first and second well units of the window well assembly when in the assembled state.
Figure 7:
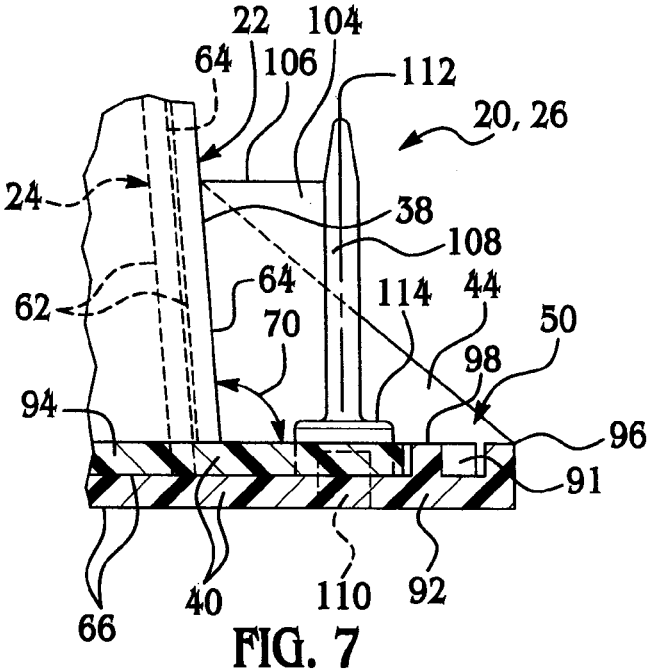
FIG. 7 is a partial cross section of the window well assembly detailing an indexing feature and taken along line 7-7 of FIG. 6.
Figure 8:
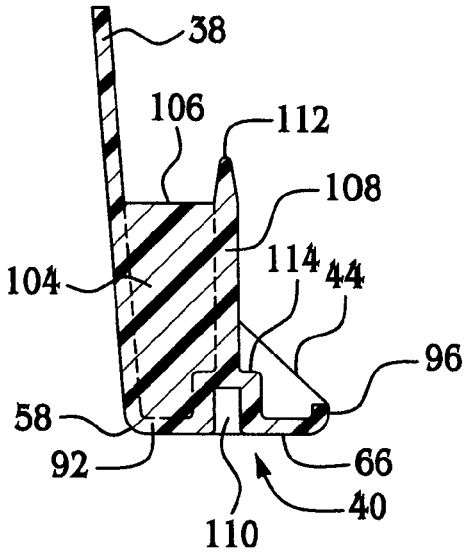
FIG. 8 is a partial cross section of the well unit taken along line 8-8 of FIG. 5.
Figure 10:
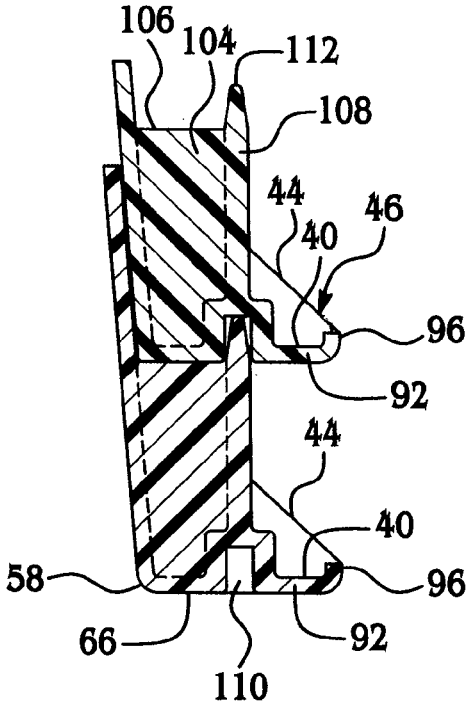
FIG. 10 is a partial cross section of the window well assembling detailing a releasable spacer coupling and when in the stored state.

Each well unit 22, 24 has a retaining wall 38 for defining in-part the cavity 36 and for retaining earth and/or construction backfill away from the foundation 30 and egress 34 when in the assembled state 26. Opposite flanges 40, 42 of each unit 22, 24 secure the retaining wall 38 to the foundation 30, and a plurality of gussets 44 extending between the flanges 40, 42 contribute toward well unit rigidity and structural integrity. Integrally carried between the first well unit 22 and the second well unit 24 are two pairs of releasable spacer couplings 46, 48 of the assembly 20 (see FIGS. 2 and 10), which are mated for compact stacking or nesting of the units when in the stored state 28. Also, integrally carried between the first well unit 22 and the second well unit 24 are first and second indexing features 50, 52 of the assembly 20 for securing and indexing the well units 22, 24 together when in the assembled state 26 (see FIGS. 1, 6 and 7). Each flange 40, 42 may have a plurality of holes 53 for receipt of fasteners (not shown) that project or fasten into the foundation 30.

The retaining wall 38 is preferably elongated and arcuate spanning laterally between a peripheral first edge 54 and an opposite peripheral second edge 56. The first and second edges 54, 56 generally conform to the curvature of the retaining wall 38 and lie within respective imaginary planes that are substantially parallel to one-another. A third edge 58 and an opposite fourth edge 60 generally flank and extend between the first and second edges 54, 56 at respective ends. The first and second edges 54, 56 are generally distal, and the third and fourth edges 58, 60 are preferably contiguous to respective first and second flanges 40, 42 of each well unit. Preferably and because in-part the foundation 30 is substantially planar, the first and second flanges 40, 42 substantially lie in a common imaginary that is substantially perpendicular to the imaginary planes of the first and second edges 54, 56.

The retaining wall 38 carries a concave inward face 62 that defines in-part the cavity 36 and an opposite outward face 64 that is generally in direct contact with surrounding earth or construction backfill when in the assembled state 26. The inward face 62 of the retaining wall 38 is contiguous to an inward surface 66 of the first and second flanges 40, 42 at the respective third and fourth edges 58, 60, and the outward face 64 is contiguous to an outward surface 68 of the first and second flanges 40, 42, at the respective third and fourth edges. Angles 70 measured between the outward face 64 of the retaining wall 38 and the outward surface 68 of the respective first and second flanges 40, 42 are preferably equal to or greater than ninety degrees.

Figure 3:
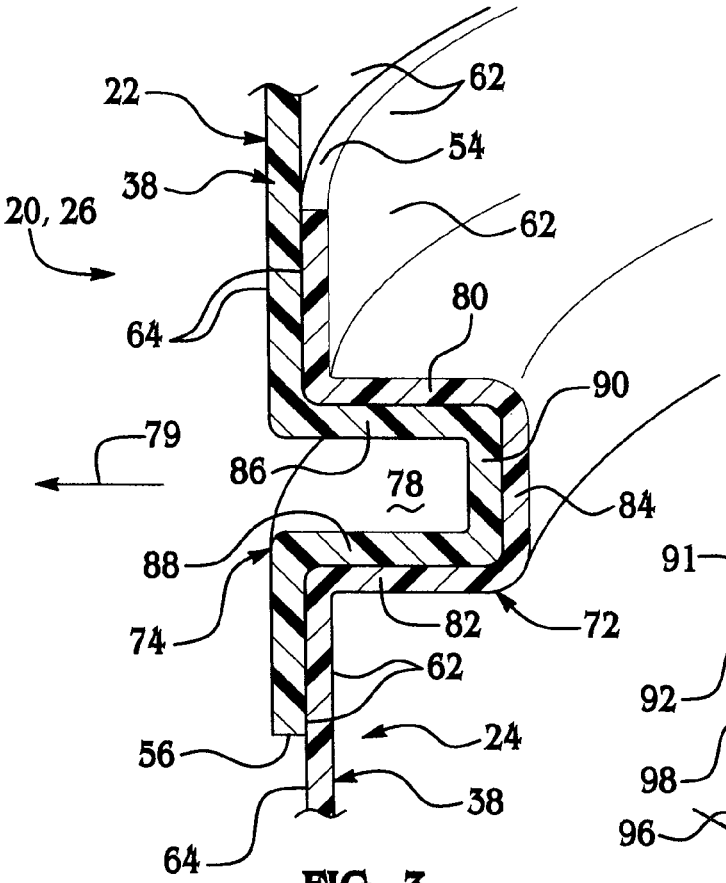
FIG. 3 is a partial cross section of the window well assembly taken along line 3-3 of FIG. 1.

Each retaining wall 38 has a longitudinal first portion 72 adjacent the first edge 54 and a longitudinal second portion 74 adjacent the second edge 56 and spaced below the first portion 72 when the assembly is in the assembled state 26. Both portions 72, 74 extend between and terminate at the first and second flanges 40, 42. The first portion 72 defines a longitudinal first channel 76 (see FIG. 1) and the second portion 74 defines a longitudinal second channel 78. Preferably, the channels 76, 78 are defined by the outward face 64 of the retaining wall 38 at the respective portions 72, 74, thus the channels laterally open in an outward and generally radial direction 79. Referring to FIG. 3, the first portion 72 generally has opposing side panels 80, 82 that flank a bottom panel 84 of the first portion 72. Similarly the second portion 74 has opposing side panels 86, 88 that flank a bottom panel 90 of the second portion 74. Similar channels are also taught in U.S. Pat. No. 7,171,786, titled "Window Well," issued Feb. 6, 2007, assigned to the same assignee as the present invention, and incorporated herein by reference it its entirety.

The opposing side panels 80, 82 and opposing side panels 86, 88 are generally illustrated as being normal to the respective bottom panels 84, 90. However, the panels 80, 82 and panels 86, 88 may flare laterally away from one-another as they project outward along direction 79 and from the respective bottom panels 84, 90. Moreover, the bottom panels 84, 90 may decrease in width as they extend longitudinally toward the flanges 40, 42, thus tapering the respective channels 76, 78 longitudinally. This flaring of side panels 80, 82, 86, 88 and tapering of bottom panels 84, 90 may potentially decrease rigidity of the well units 22, 24, however, it may also assist in guiding the units 22, 24 together when being nested in the stored state 28 and being stacked in the assembled state 26.

Referring to FIG. 3, the first channel 76 has a lateral cross section that is generally larger than the second channel 78 for nesting of the units 22, 24. More specifically, the inward face 62 of the retaining wall 38 at the overlapping second portion 74 of the first well unit 22 is in direct contact with the outward face 64 of the retaining wall 38 at the overlapping first portion 72 of the second well unit 24. For this to occur, the width of the bottom panel 90 of the second portion 74 must be less than the width of the bottom panel 84 of the first portion 72 by an amount equal to or slightly greater than the thickness of the first panel 86 plus the thickness of the second panel 88 of the second portion 74. One skilled in the art however, would now know that the cross section sizing of the first and second channels 76, 78 can be reversed. This reversal, however, would eliminate water round-off advantages or the flashing effect against ground water seepage that the preferred embodiment has. Yet further, one skilled in the art would also now realize that the channels 76, 78 may also open laterally inward thus communicating directly with the cavity 36. Moreover, one skilled in the art would now know that additional channels may be spaced laterally inward from the first and second channels 76, 78 for adding additional rigidity to the assembly 20.

Figure 4:
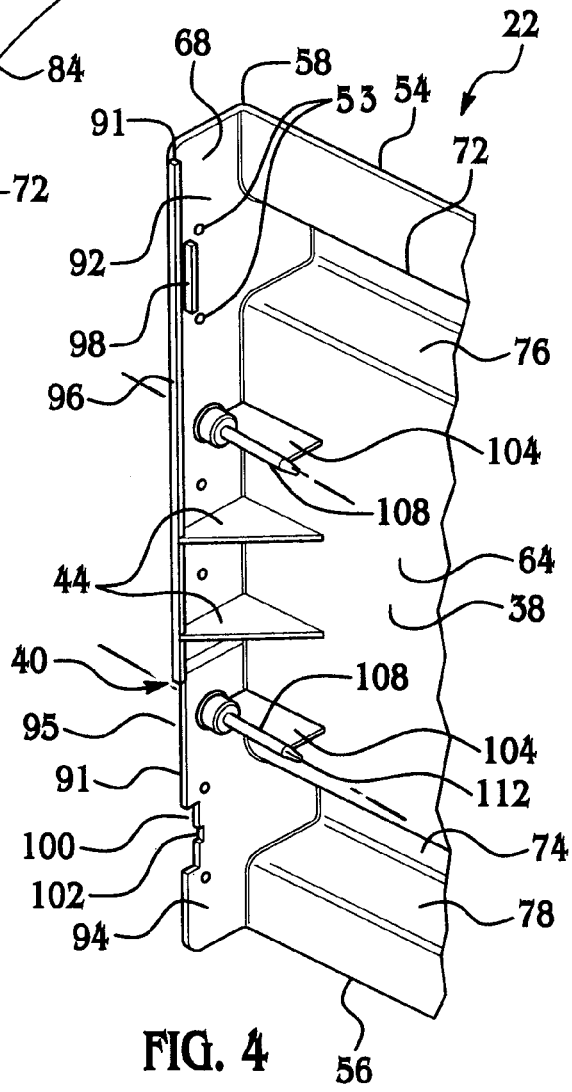
FIG. 4 is an enlarged partial perspective view of a first flange of a well unit of the window well assembly.
Figure 5:
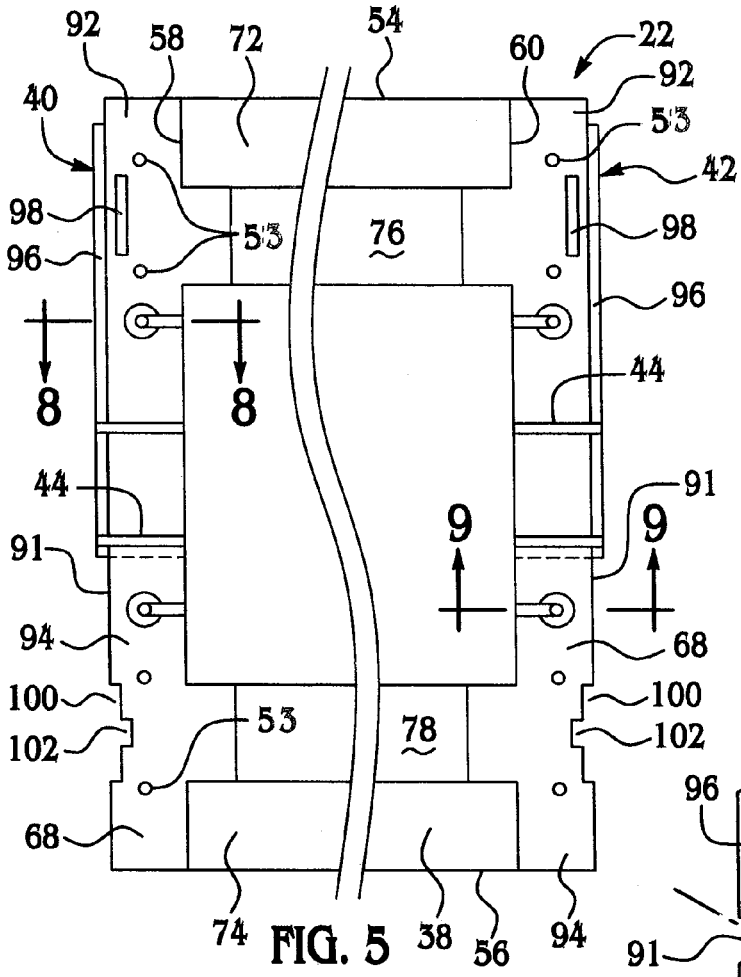
FIG. 5 is a broken plan view of the window well.
Figure 9:
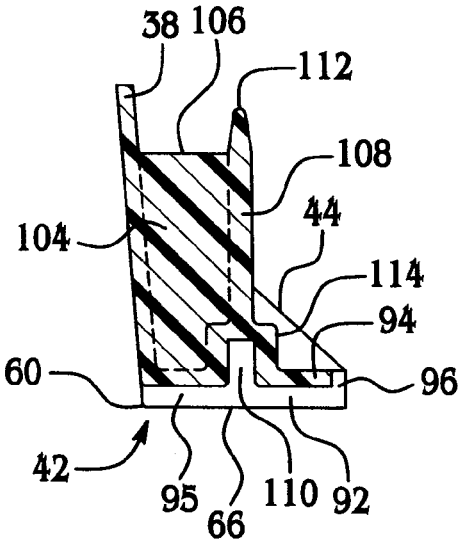
FIG. 9 is a partial cross section of the well unit taken along line 9-9 of FIG. 5.

When in the assembled state 26, the second portion 74 of the retaining wall 38 of the first well unit 22 overlaps the first portion 72 of the retaining wall 38 of the second well unit 24. Similarly, second segments 94 of the first and second flanges 40, 42 of the first well unit 22 overlap respective first segments 92 of the respective first and second flanges 40, 42 of the second well unit 24. Generally, the inward surface 66 at the first segments 92 is in direct contact with the foundation 30 and the inward surface 66 carried by or at the second segments 94 is spaced from the foundation 30 by the respective first segments 92 of the adjacent well unit when assembled and installed. That is, the flanges 40, 42 are each generally offset and the inward surface 66 at the second segments 94 generally define recesses 95 (see FIGS. 4 and 9) for receipt of at least a portion of the first segments 92 of the next adjacent well unit. The first segments 92 may be substantially longer than the second segments 94 depending upon the degree of desired overlap for structural integrity of the assembly 20 when in the assembled state 26.

Referring to FIGS. 1 and 4-7, each flange 40, 42 projects laterally outward from the retaining wall 38 to respective distal edges 91 of the flanges. The edges 91 are substantially vertical when the assembly 20 is in the assembled or installed state 26. Both the first and second segments 92, 94 span laterally between the retaining wall 38 and the shared distal edge 91. In-part and to enhance structural integrity of the flanges 40, 42, a longitudinal lip or rim 96 projects laterally outward from the first segment 92 at the distal edge 91 and extends longitudinally along, substantially, the entire length of the first segment. When the assembly 20 is in the assembled state 26, the distal edge 91 at the second segment 94 of the first well unit 22 opposes and is in contact with an inward side of the lip 96 of the first segment 92 of the second well unit 24. This association serves to further index the first well unit 22 to the second well unit 24 and prevents outward spreading or distortion of the first well unit 22 with respect to the cavity 36 and in direction 97 (see FIG. 6).

The first and second indexing features 50, 52 are preferably of a snap lock type for indexing and securing the units 22, 24 together during the assembly process. Each indexing feature 50, 52 is generally carried between the first segment 92 of both flanges 40, 42 of the second well unit 24 and the respective second segments 94 of both flanges 40, 42 of the first well unit 22. For simplicity of explanation, the first indexing feature 50 will be described as supported by the first flanges 40 of units 22, 24 and with the understanding that the second indexing feature 52 is identical except generally carried by the second flanges 42. With regard to feature 50, spaced generally inward from the lip 96 is a co-extending rib 98 that projects laterally outward from the outward surface 68 at the first segment 92. The rib 98 is substantially parallel to lip 96 but considerably shorter because it may merely serve as an indexing and lock feature as opposed to the structural attributes of the lip. Feature 50 also has a notch 100 defined by the distal edge 91 and in the second segment 94 of the first flange 40 for snap receipt of the rib 98. A smaller notch or key-hole 102 also defined by edge 91 communicates off the notch 100 for insertion of a tool, such as a screw driver, for unsnapping or prying apart the indexing feature 50 if a need arises. When the assembly 20 is in the assembled state, the rib 98 of the second well unit 24 projects through the notch 100 of the first well unit 22, and preferably the distal edge 91 of flange 40 of well unit 22 is resiliently pressed or biased against the rib 98 of first segment 92 of flange 40 of well unit 24.

Referring to FIGS. 2 and 7-10, the assembly 20 is capable of being packaged, stored, and shipped in one compact configuration (i.e. the stored state 28) of the well units 22, 24 and any number of additional well units. The first pair of releasable spacer couplings 46 is generally carried between the first flanges 40 of the respective well unit 22, 24, and the second pair of releasable spacer couplings 48 are carried between the second flanges 42 of the respective well units 22, 24. Preferably, when the assembly 20 is in the stored state 28 the ends of the first portion 72 of the first well unit 22 are partially nestled in ends of the groove 76 of the second well unit 24. Similarly, the ends of the second portion 74 of the first well unit 22 are partially nestled in ends of the groove 78 of the second well unit 24. To partially nestle, the sidewalls 80, 82 of the first portion 72 and the sidewalls 86, 88 of the second portion 74 may flare laterally outward as previously described.

Each coupling 46, 48 has a web 104 that projects contiguously outward from the outward face 64 of the retaining wall 38 and the outward surfaces 68 of the first and second flanges 40, 42. A distal stop edge 106 of the web 104 is substantially parallel to and spaced outward from the flanges 40, 42 by a distance generally dictated by the angle 70 and the lateral taper of the sidewalls 80, 82, 86, 88. This distance is large enough so that the inward surface 66 of the flanges 40, 42 preferably rest against the distal edges 106 when the assembly is in the stored state 28 to prevent the well units from sticking together, yet is small enough to maximize the overall compact configuration of the stored state.

Each coupling 46, 48 may also have an elongated protrusion 108 and a corresponding bore or aperture 110. Each protrusion 108 projects upward or outward along a centerline from the outward surface 68 of the flanges 40, 42 and to a distal end or tapered tip 112 preferably spaced further from the outward surface 68 than the distal edge 106 of the web 104. The web 104 and thus the distal edge 106 preferably spans radially outward from the elongated protrusion 108 to contiguously form to the outward face 64 of the retaining wall 38, providing strength to the couplings 46, 48. The bore 110 in the flanges 40, 42 communicates through the inward surface 66 of the flanges 40, 42 and is defined at least in-part by an enlarged, hollow, base 114 of the protrusion 108. When the assembly 20 is in the stored state 28, the tapered tip 112 of the protrusion 108 of the respective flanges 40, 42 of the second well unit 24 is fitted in the blind bore 110 in the respective flanges 40, 42 of the well unit 22. When the assembly 20 is in the stored state 28 lateral contact of the tips 112 of the second well unit 24 with the flanges 40, 42 and/or inner stops of the enlarged bases 114 of the protrusions 108 of the well unit 22 prevent the well unit 22 from generally flattening or distorting outward in direction 97 (see FIG. 2). Preferably, the protrusion 108, the base 114 and bore 110 are concentric to one another and substantially perpendicular to flanges 40, 42.

While the forms of the invention herein disclosed constitute a presently preferred embodiments, many others are possible. It is not intended herein to mention all the possible equivalent forms or ramification of the invention. It is understood that terms used herein are merely descriptive, rather than limiting, and that various changes may be made without departing from the spirit or scope of the invention.

The invention claimed is:

1. A window well assembly generally for the retention of earth away from a subgrade foundation of a building and the defining of a cavity therebetween, the window well assembly comprising:

first and second well units each having a retaining wall, a first flange and an opposite second flange;

wherein the retaining wall of the first well unit projects above the retaining wall of the second well unit when the assembly is in an assembled state;

a spacer coupling carried integrally between the first and second well units;

wherein the spacer coupling is mated when the assembly is in a stored state and is unmated when the assembly is in the assembled state;

an indexing feature carried integrally between the first and second well units and comprising a first snap lock feature carried between the first flange of the first well unit and the first flange of the second well unit, and a second snap lock feature carried between the second flange of the first well unit and the second flange of the second well unit; and wherein the indexing feature is mated when the assembly is in the assembled state and is unmated when the assembly is in the stored state, the first and second well units indexed and secured together through the first and second snap lock features in the assembled state.

2. The window well assembly set forth in claim 1 wherein the first and second flanges of the first and second well units lie at least in part in a common imaginary plane.

3. The window well assembly set forth in claim 2 wherein a portion of the first and second flanges of the first well unit overlaps a portion of the respective first and second flanges of the second well unit when in the assembled state.

4. The window well assembly set forth in claim 1 further comprising:

the first and second well units being elongated and extending longitudinally between the respective first and second flanges;

the first and second well units each having a longitudinal first portion adjacent the first edge and defining a longitudinal first channel, and a longitudinal second portion adjacent the second edge and defining a longitudinal second channel; and wherein the second channel of the first well unit co-extends longitudinally with the first channel of the second well unit when in the assembled state.

5. The window well assembly set forth in claim 4 wherein the second portion of the first well unit is disposed in the second channel of the second well unit when in the assembled state.

6. A window well assembly generally for the retention of earth away from a subgrade foundation of a building and the defining of a cavity therebetween, the window well assembly comprising:

an arcuate wall having an outward face constructed and arranged to face the earth, an inward face constructed and arranged to define the cavity and peripheral first, second, third and fourth edges, wherein the first and second edges are arcuate and opposite to one-another and the third and fourth edges flank the first and second edges and are opposite to one-another;

a first flange projecting outward from the outward face along the third edge;

an opposite second flange projecting outward from the outward face along the fourth edge;

first and second webs contiguous to the outward face and the respective first and second flanges, the first and second webs each having a distal stop edge spaced outward from and parallel to the respective first and second flanges;

the first and second flanges each having an outward surface contiguous to the outward face and an inward surface contiguous to the inward face, the first and second flanges respectively having first and second apertures therein defined by the respective inward surfaces; and first and second protrusions projecting away from the outward surfaces of the respective first and second flanges along respective first and second centerlines spaced radially away from the outward face and disposed perpendicular to the respective flanges.

7. The window well assembly set forth in claim 6 wherein the first and second flanges substantially lie in a common imaginary plane.

8. The window well assembly set forth in claim 6 wherein the arcuate wall, the first flange, the second flange, and the first and second webs define a first well unit; and further comprising:

a second well unit having:

an arcuate wall having an outward face constructed and arranged to face the earth, an inward face constructed and arranged to define in-part the cavity and peripheral first, second, third and fourth edges, wherein the first and second edges are arcuate and opposite to one-another and the third and fourth edges flank the first and second edges and are opposite to one-another, a first flange projecting outward from the outward face along the third edge, an opposite second flange projecting outward from the outward face along the fourth edge, and first and second webs contiguous to the outward face and the respective first and second flanges, the first and second webs each having a distal stop edge spaced outward from and parallel to the respective first and second flanges; and wherein the first flange of the first well unit is in releasable contact with the distal stop of one of the first and second webs of the second well unit and the second flange of the first well unit is in releasable contact with the distal stop edge of the other of the first and second webs of the second well unit for spacing the inward face of the first well unit away from the outward face of the second well unit when the assembly is in a stored state and prior to assembly.

9. The window well assembly set forth in claim 8 wherein the third and fourth edges of the first and second well units extend substantially vertically and the first flange of the first well unit is located at least in-part above the first flange of the second well unit and the second flange of the first well unit is located at least in-part above the second flange of the second well unit when the assembly is assembled and the first and second flanges of the first and second well units are engaged to the foundation.

10. The window well assembly set forth in claim 6 wherein the first and second apertures are associated with the first and second protrusions.

11. The window well assembly set forth in claim 10 wherein the first and second protrusions project beyond the distal stop edges of the respective first and second webs.

12. The window well assembly set forth in claim 11 wherein the arcuate wall, the first flange, the second flange, and the first and second webs define a first well unit; and further comprising:

a second well unit having:

an arcuate wall having an outward face constructed and arranged to face the earth, an inward face constructed and arranged to define in-part the cavity and peripheral first, second, third and fourth edges, wherein the first and second edges are arcuate and opposite to one-another and the third and fourth edges flank the first and second edges and are opposite to one-another, a first flange projecting outward from the outward face along the third edge, an opposite second flange projecting outward from the outward face along the fourth edge, first and second webs contiguous to the outward face and the respective first and second flanges, the first and second webs each having a distal stop edge spaced outward from and parallel to the respective first and second flanges, the first and second flanges each having an outward surface contiguous to the outward face and an inward surface contiguous to the inward face;

first and second apertures in the respective first and second flanges and defined by the respective inward surfaces, and first and second protrusions projecting away from the outward surfaces of the respective first and second flanges along respective first and second centerlines spaced radially away from the outward face and disposed perpendicular to the respective first and second flanges; and wherein the first aperture of the first well unit is releasably mated to one of the first and second protrusions of the second well unit and the second aperture of the first well unit is releasably mated to the other of the first and second protrusions of the second well unit for preventing distortion of the first and second well units when the assembly is in a stored state and prior to assembly.

13. The window well assembly set forth in claim 12 wherein the inward surface of the first flange of the first well unit is in releasable contact with the distal stop edge of one of the first and second webs of the second well unit and the inward face of the second flange of the first well unit is in releasable contact with the distal stop edge of the other first and second webs of the second well unit for spacing the inward face of the first well unit away from the outward face of the second well unit when the assembly is in a stored state and prior to assembly.

14. A well unit of a window well assembly for a building, comprising:

a retaining wall that is generally U-shaped in plan view and having a convex outward face, an opposite concave inward face, and peripheral first, second, third and fourth edges, wherein the first and second edges are generally U-shaped and opposite to one-another and the third and fourth edges extend between the first and second edges and are opposite to one-another;

first and second mounting flanges extending transversely from the outward face and along respective third and fourth edges, the first and second mounting flanges each having an outward surface and an opposite inward surface, wherein at least a portion of the inward surface is adapted to secure directly to a vertical foundation of the building;

first and second protrusions projecting from the outward surfaces of the respective first and second flanges for nesting a plurality of well units, each of the plurality of well units having the same size and shape as the well unit, wherein the first and second protrusions are spaced away from the outward face; and first and second apertures in the respective first and second flanges each contoured to receive at least a portion of the first and second protrusions of an adjacent, nested well unit of the plurality of well units.

15. The well unit set forth in claim 14 further comprising first and second webs extending between the outward face and the respective first and second protrusions for spacing the inward face of the well unit away from an outward face of the next adjacent well unit.

16. The well unit set forth in claim 15 wherein the well unit is made of a polymer material having a one-piece unitary construction.

17. The well unit set forth in claim 14 wherein the first and second apertures are directly opposite the first and second protrusions.

18. The well unit set forth in claim 17 wherein the first and second apertures are blind bores that communicate through the respective first and second flanges and are defined at least in part by the respective first and second protrusions.

19. The well unit set forth in claim 14 further comprising the first and second flanges each having a first portion projecting laterally from the respective third and fourth edges and located in a common imaginary plane and second portions projecting laterally from the respective third and fourth edges and spaced outward from the common imaginary plane by a thickness of the first portion.

20. The well unit set forth in claim 17 further comprising:

the first and second flanges each having a distal edge substantially parallel to the respective third and fourth edges;

first portions of the first and second flanges each having a lip projecting outward from and co-extending with the distal edge and a rib spaced inward from the lip and projecting outward from the outward surface; and second portions of the first and second flanges each having a notch defined by the distal edges and associated with the ribs of the first and second flanges for snap fitting the well unit to an adjacent well unit.

21. A window well assembly generally for the retention of earth away from a subgrade foundation of a building and the defining of a cavity therebetween, the window wall assembly comprising: a first well unit having a wall having a convex outward face facing the earth, a concave inward face facing the cavity and peripheral first, second, third and fourth edges, wherein the first and second edges are opposite to one-another and wherein the third and fourth edges flank the first and second edges, a first flange projecting outward from the outward face along the third edge, an opposite second flange projecting outward from the outward face along the fourth edge, first and second protrusions projecting outward from and perpendicular to the respective first and second flanges, and first and second apertures in the respective first and second flanges associated with the first and second protrusions; a second well unit being identical to the first well unit and having a wall, a first flange, an opposite second flange, first and second protrusions, and first and second apertures; and wherein the first aperture in the first well unit receives one of the first and second protrusions of the second well unit and the second aperture of the first well unit is mated to the other of the first and second protrusions of the second well unit.

* * * * *